United States Patent [19]

Atwood

[11] Patent Number: 4,639,234

[45] Date of Patent: Jan. 27, 1987

[54] TOY PLAY SET WITH PUPPET FOR TOY ACTION FIGURES

[75] Inventor: Robert W. Atwood, Whittier, Calif.

[73] Assignee: Mattel, Inc., Hawthorne, Calif.

[21] Appl. No.: 784,147

[22] Filed: Oct. 4, 1985

[51] Int. Cl.[4] ..... A63H 33/00

[52] U.S. Cl. ..... 446/327; 446/476; 446/486

[58] Field of Search ..... 446/327, 476, 83, 82, 446/268, 491, 487, 329

[56] References Cited

U.S. PATENT DOCUMENTS

| | | | |
|---|---|---|---|
| 1,324,646 | 12/1919 | Clements . | |
| 2,687,887 | 8/1954 | Frampton | 272/27 |
| 2,725,670 | 12/1955 | Hodes | 446/327 |
| 2,874,513 | 2/1959 | Connell . | |
| 3,034,255 | 5/1962 | Bacon . | |
| 3,142,131 | 7/1964 | Von Rabenau . | |
| 3,199,249 | 8/1965 | Carver et al. . | |
| 3,354,577 | 11/1967 | Glass et al. . | |
| 3,394,493 | 7/1968 | Glass et al. . | |
| 3,603,029 | 9/1971 | Nutting . | |
| 4,105,206 | 8/1978 | Soulos | 273/85 |
| 4,209,940 | 7/1980 | Meyer et al. . | |
| 4,316,345 | 2/1982 | Rivette et al. . | |
| 4,373,289 | 2/1983 | Douglas et al. | 446/487 |

*Primary Examiner*—Mickey Yu

*Attorney, Agent, or Firm*—Ronald M. Goldman; Melvin A. Klein; Daniel F. Sullivan

[57] ABSTRACT

A toy playset for use with toy action figures including a simulated cage having a door, an arrangement for securing and releasing the door capable of being reached by a toy action figure used with the playset, a trap capable of ensnaring a toy action figure positioned in front of the cage, a hand-puppet monster guarding the cage, and a tree capable of grasping a toy action figure positioned to guard the arrangement for releasing the door.

7 Claims, 6 Drawing Figures

TOY PLAY SET WITH PUPPET FOR TOY ACTION FIGURES

BACKGROUND OF THE INVENTION

This invention relates to play sets and, more particularly, to play sets to be utilzed with toy action figures.

There are many and varied toy action figures available to the modern child. For example, there are toy action figures depicting spacemen, robots, monsters, aliens, soldiers and many other beings which children conceive as adventurous. One important type of toy action figures now available involves figures which depict warriors and other characters from the ancient mythical fables or the present day stories derived from those fables. Such action figures include the men, the various beings with whom they associated, the beasts and monsters they encountered, and all of the other characters from those stories and fables.

SUMMARY OF THE INVENTION

It is an object of the present invention to provide a toy play set which enhances the play value of toy action figures by interrelating the various toy action figures into an oriented whole.

It is another object of the present invention to provide a toy play set which presents a thematic episode for toy action figures.

These and other objects of the invention are accomplished in a play set which provides a background depicting a rock-like prison in which a toy action figure may be held by the enemy of that figure. The prison has a door with a release which must be operated to release the figure. The release may only be operated after passing various tests. The tests include a trapdoor arrangement just in front of the prison door over which a hero may stumble, fall, and be captured; an eerie, grasping, hand-operated tree filled with brooding vultures the limbs of which may grasp and hold an unwary hero reaching for the release; and a gigantic, vicious, hand puppet serpent which guards the prison door and may easily catch and devour any hero attempting to open it. The entire arrangement provides an exciting exhancement of play for toy action figures.

Other objects and advantages of the invention will be better understood by reference to the specification taken in conjunction with the detailed drawings in which like elements are referred to by like reference characters throughout the several views.

DESCRIPTION OF THE PREFERRED EMBODIMENT

Figure 1:
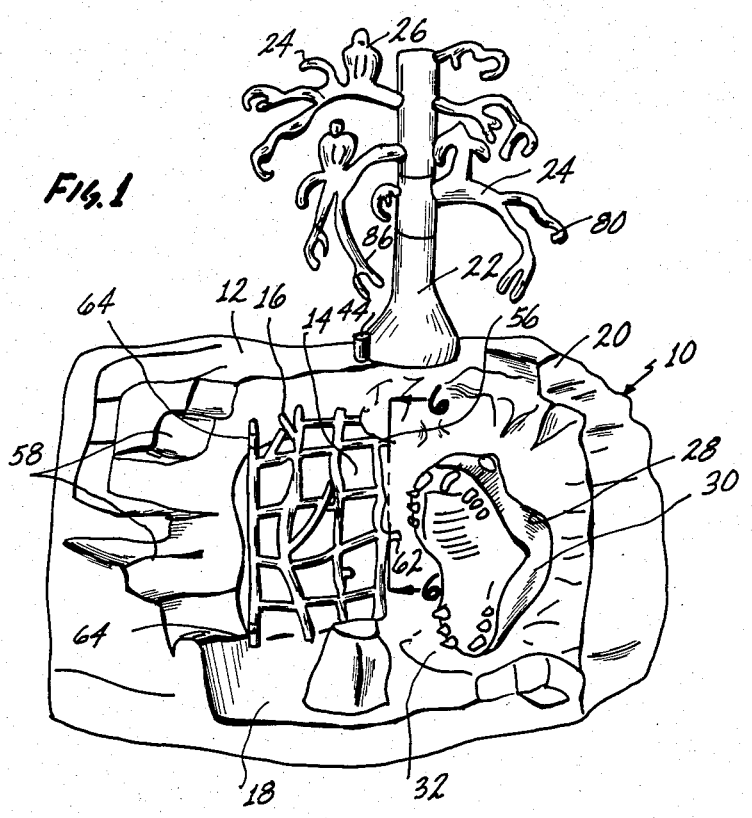
FIG. 1 is a perspective view of the play set of this invention.

Referring now to FIG. 1, there is shown a toy play set 10 which includes a rock-simulating, fortress-like base 12 having a cave-like opening 14 therein. The cave-like opening 14 is closed by a door 16 which in the preferred version is formed to simulate interwoven vines with openings therebetween to allow a toy action figure within the opening 14 to be viewed from without. The base 12 is, in a preferred version, molded of a plastic material and includes a floor portion 18 and a back and side wall 20. The use of a moldable plastic material in forming the base 12 allows the floor 18 and the wall 20 to be shaped in such a way as to emulate a rugged, stone covered landscape and a stone fortress-like structure, respectively.

Positioned upon the wall 20 is a tree 22 having a number of branches 24 and FIGS. 26 positioned on those branches 24 representing vultures in a preferred embodiment. The tree 22 is preferably constructed of a moldable plastic material and has a mechanism (not shown in FIG. 1), which will be explained below, which allows a child utilizing the play set 10 to swing lower ones of the branches together like arms to grasp objects positioned on the top of the wall 20 in front or to the side of the tree 22 thereby enhancing the dangerous and eerie nature of the play set 10.

Positioned in a circular opening 28 in the right side (FIG. 1) of the wall 20 is a hand puppet 30 which emulates, in a preferred version of the invention, a serpent or monster of horrifying characteristics. The serpent puppet 30 may be constructed of a thin, flexible plastic material and have a relatively long neck portion adapted to reach a substantial portion of the floor 18 in front of the door 16.

Figure 4:
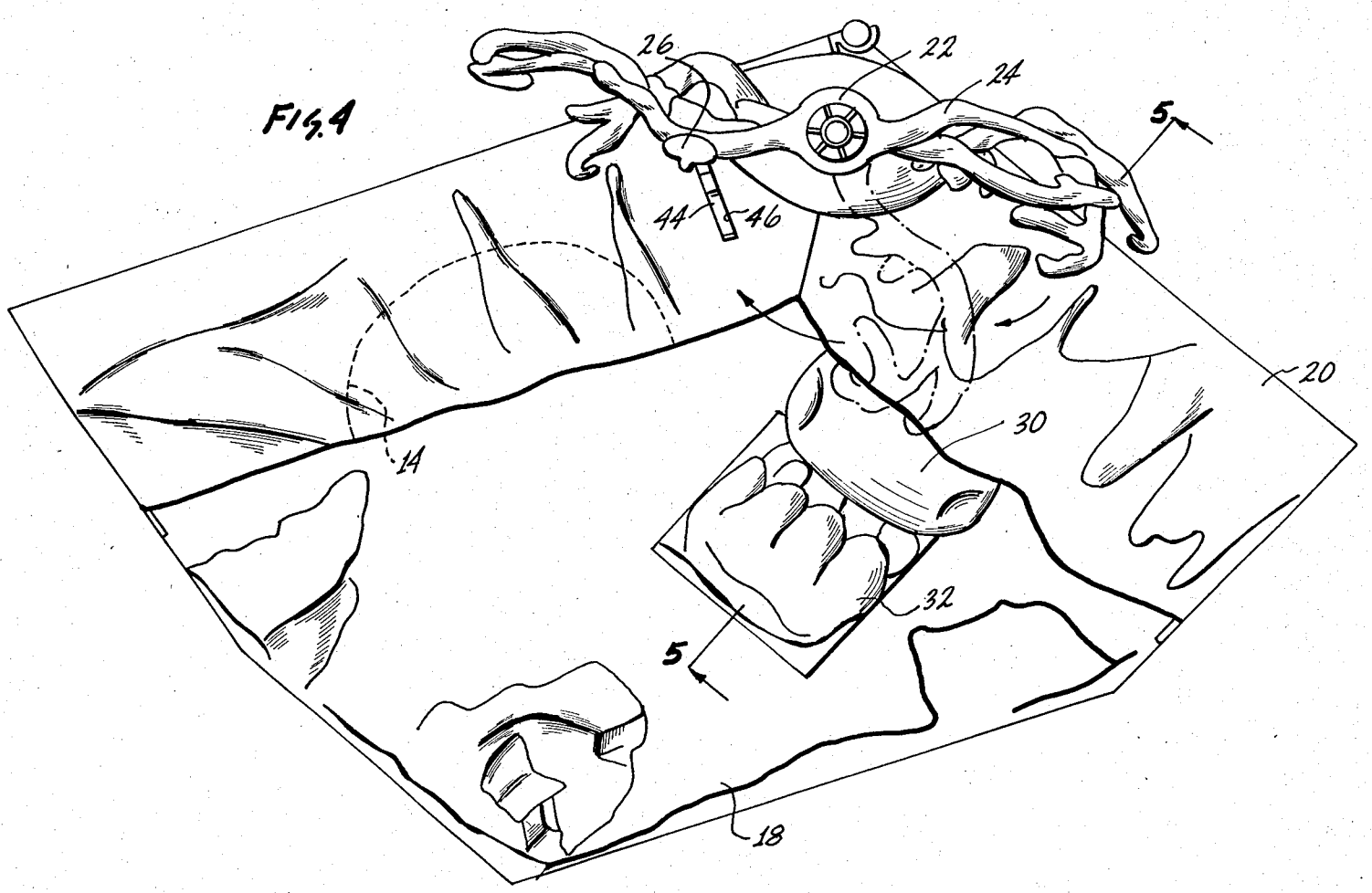
FIG. 4 is a top view of the play set shown in FIG. 1.
Figure 5:
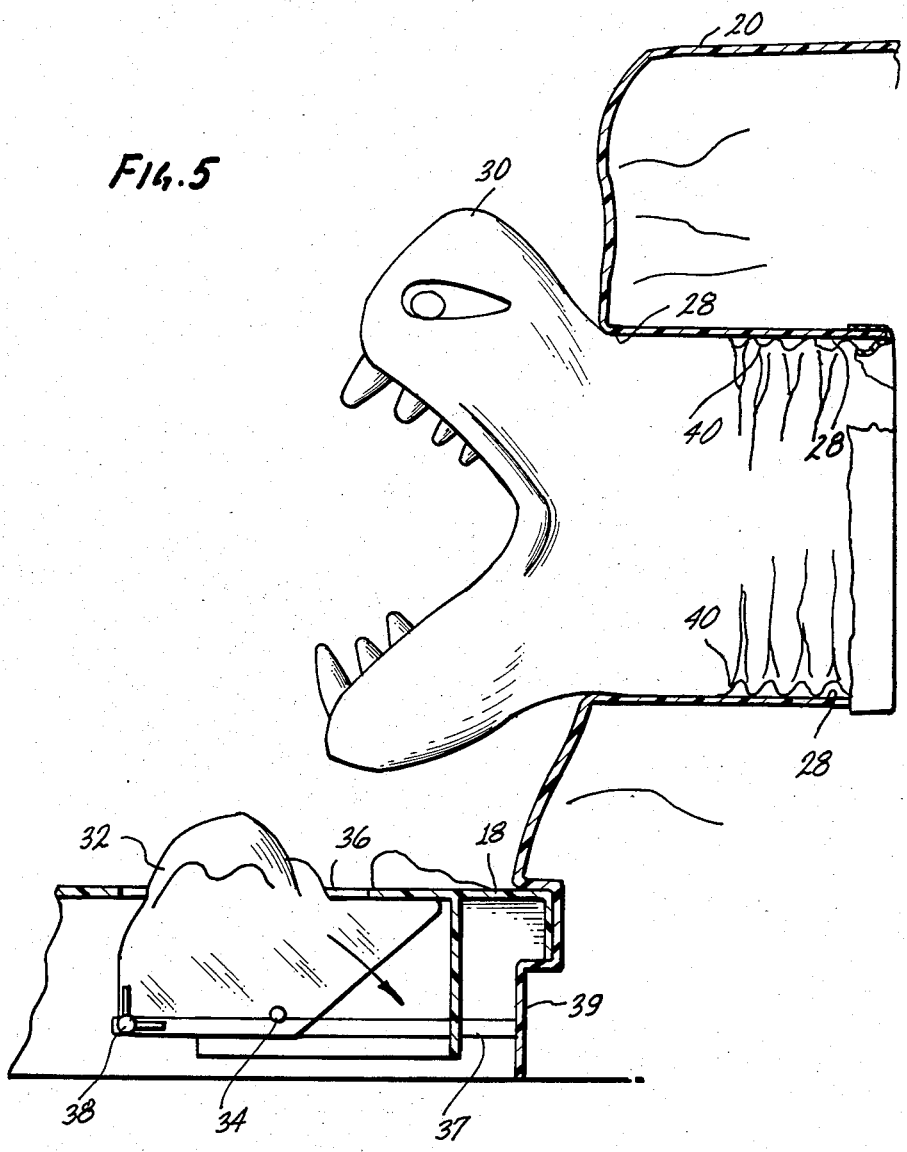
FIG. 5 is a side view, in cross-section, of the arrangement shown in FIG. 4 illustrating particularly a serpent and a trap arrangement.

A rotating, trap 32 is positioned in the floor 18 in front of the door 16 and the puppet 30 in such a manner as to ensnare an unwary action figure and cause that figure to fall immediately in front of the serpent 30. The trap 32 is best illustrated in FIGS. 4 and 5. In FIG. 4, the trap 32 is illustrated from above and is shown to be constructed of a material such as a moldable plastic so that the upper surface thereof appears similar to the surrounding area of the floor 18. In a preferred embodiment, the upper surface of the trap 32 is constructed to look like a rugged rock strewn surface. As may be seen in FIG. 5, the trap 32 rotates about an axis 34. If an action figure is caused to step at a point 36, that point 36 will rotate downwardly with the action figure causing the figure to appear to stumble and fall. An elastic band 37 secured by projections 38 on the trap 32 and stretched around a wall 39 of the base 18 biases the trap 32 so that it holds the leg of any action figure stepping on the point 36.

FIG. 5 also illustrates the arrangement by which the serpent puppet 30 may be operated by a child placing a hand into the rear thereof through the opening 28 in the wall 20. It will be noted that the puppet 30 is constructed of a thin material affixed to the wall of the opening 28 at the right side of FIG. 5. A substantial amount of this material is collapsed at 40 and pressed back into the opening 28 so that the puppet 30 may be extended outwardly into the area in front of the door 16 and made to emulate a serpent grasping at an action figure in that area. In this manner, the puppet 30 may be made to act as a giard for the prison-like cave 14, deterring action figures from rescuing others enclosed in the cave 14.

Figure 6:
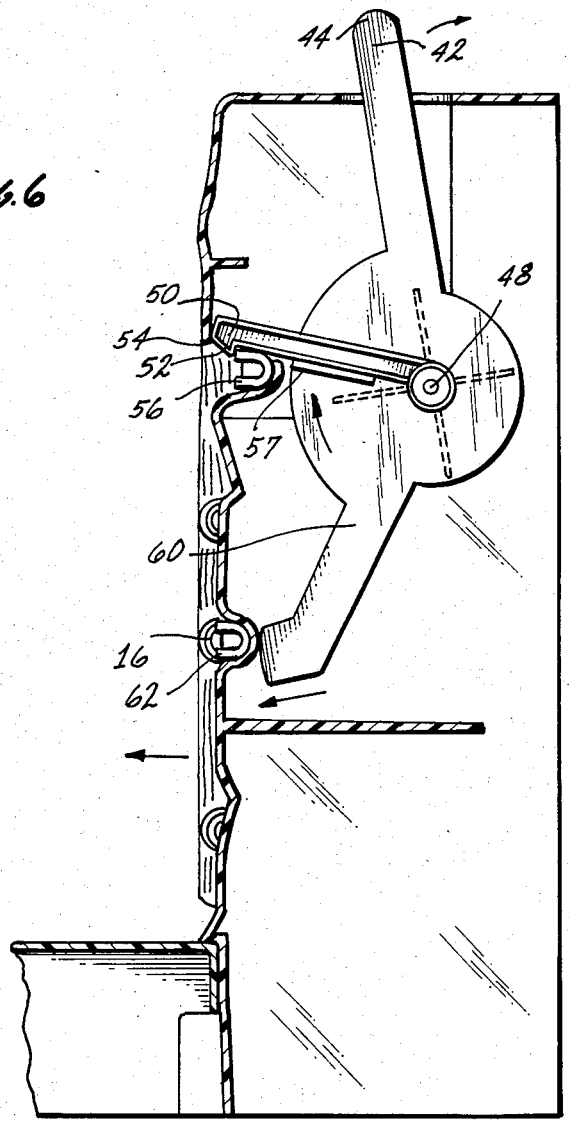
FIG. 6 is another cross-section taken at line 6—6 of FIG. 1.

Shown in FIGS. 1, 4, and 6 is a device 42 for both opening and closing the door 16 of the cave 14. This device 42 includes a handle 44 which extends through a slot 46 in the upper surface of the wall 20 so that it may be reached by an action figure attempting to rescue a figure from the cave 14. The device 42 extends downwardly from the projecting handle 44 and rotates about an axis 48 to move a locking device which includes an arm 50 and a detente 52. The detente 52 projects in its lower position through an opening 54 in the front surface of the wall 20 and fits down over a bar 56 which is a part of the door 16. When the arm 44 is rotated to the left in FIG. 6, the detente 52 holds the bar 56 so that the door 16 is closed. When the detente 44 is pushed to the right as shown by the arrow in FIG. 6, a second arm 60 projecting from the device 42 is urged against a second bar 62 of the door 16 to cause the door 16 to rotate outwardly upon hinges 64 at the opposite side and swing open. Thus, by moving the handle 44 of the device 42, an action figure may open the door 16 and release any figure imprisoned in the opening 14. To assist such a rescue, the wall 20 has steps 58 cast therein in the preferred embodiment.

Figure 3:
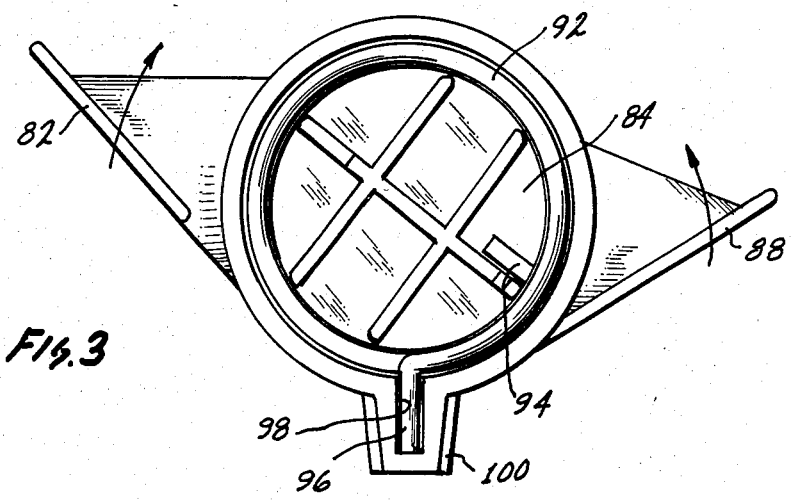
FIG. 3 is a cross-section of the base of the tree shown in FIG. 2.
Figure 2:
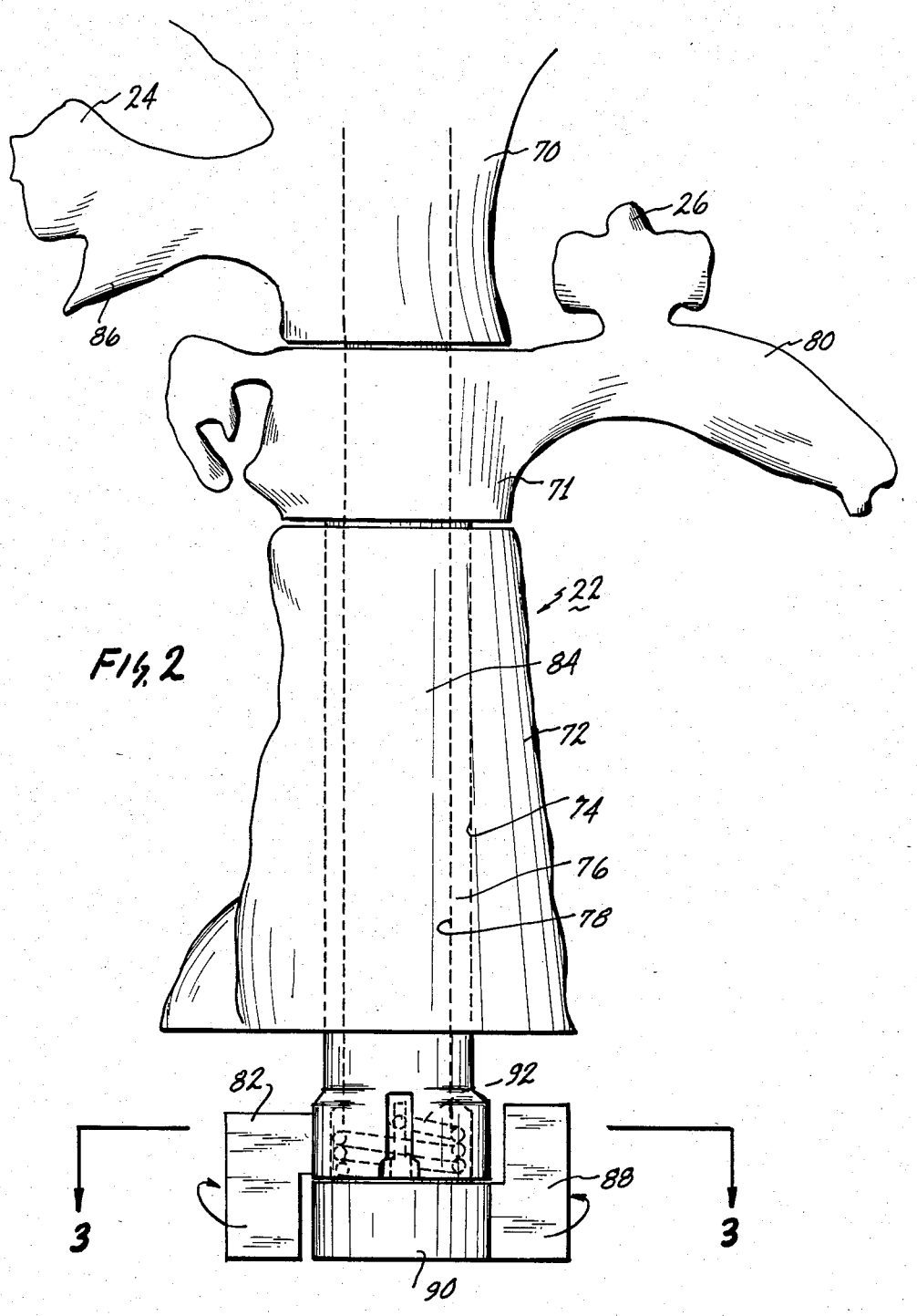
FIG. 2 is a detailed view of a grasping tree utilized in the play set shown in FIG. 1.

However, in addition to the trap 32 and the serpent puppet 30 which guard the front entrance to the cave 14, the tree 22 is positioned to grasp any figure which attempts to reach the handle 44. The means by which this is accomplished is shown in FIGS. 2, 3, and 4. As may be seen in FIG. 2, the tree 22 includes three main portions 70, 71, and 72. The lower portion 72 is constructed in the preferred version of a moldable plastic material and has a central cylindrical bore 74 therethrough. This portion 72 of the tree 22 is positioned upon the upper surface of the wall 20 and is held in place by means well known to the prior art.

The portion 71 of the tree 22 is positioned above the portion 72 and has depending therefrom a hollow cylinder 76 having a central bore 78. The outer diameter of the cylinder 76 is adapted to fit within the bore 74 of the portion 72 thereby holding the portion 71 in place and allowing it to rotate about the axis of the bore 74 so that a limb 80 of the tree 22 may be caused to move about the axis of the bore 74. This movement may be induced by the application of pressure upon a flange 82 which extends from the base of the cylinder 76 and is positioned such that a child operating the play set 10 may reach the flange 82.

Positioned above the portion 71 is the portion 70 of the tree 22. The portion 70 has a cylindrical extension 84 depending therefrom having an outer diameter such as to fit within the bore 78 of the cylinder 76 so that the portion 70 of the tree 22 is held in place above the portion 71 thereof and may be made to rotate upon the cylinder 84 about the axis of the bore 74. It will be obvious to those skilled in the art that such a rotation causes the branches 24 of that portion 70 to swing about the axis of the bore 74. More particularily, a limb 86 of the portion 70 is positioned to oppose the limb 80 of the portion 71 so that if the two portions 70 and 71 are rotated in opposite directions about the axis of the bore 74, the limbs 80 and 86 will grasp together as might arms of a person.

The movement of the limb 86 of the portion 70 about the axis of the bore 74 is enabled by a flange 88 connected to an enlarged portion 90 attached to the base of the cylindrical extension 84. In order to enhance the operation of the limbs 80 and 86 of the tree 22 for a child operating the device 10, a spring 92 is positioned to surround the depending cylinder 84 and to have one end 94 held fixedly in place by the cylinder 84 and the other end 96 held fixedly in place in a slot 98 in an extending portion 100 in the side wall of the cylinder 76. As may be seen in FIG. 3, by moving the flanges 82 and 88 in the direction of the arrows shown in the figure, the limbs 80 and 86 of the portions 71 and 70, respectively, of the tree 22 may be caused to close together and, upon release of the flanges 82 and 88, to spring apart under impetus of the spring 92. Thus, a child operating the mechanism of the tree 22 may grasp with the limbs 80 and 86 at an action figure positioned upon the upper surface of the wall 20.

Thus, it will be understood by those skilled in the art that two or more children may operate the play set of the invention. By causing various action figures to approach the cave opening 14 and attempt to rescue figures held therein, extremely realistic play may be practiced including an encounter with the trap 32, an attack by the serpent puppet 30, and an engulfing by the tree 22.

It is to be understood that various other arrangements than those shown in the specification may occur to those skilled in the art without departing from the spirit and scope of the invention. It is, therefore, to be understood that the invention is to be limited only by the spirit and scope of the claims appended hereto.

What is claimed is:

1. A toy playset for use with toy action figures comprising means for simulating a cage having a door, means for securing and releasing the door, means for simulating a trap capable of ensnaring a toy action figure, means for simulating a monster guarding the cage, and means for simulating a tree capable of grasping a toy action figure.

2. A toy playset as claimed in claim 1 wherein the means for securing and releasing the door comprises a lock release which may be reached by a toy action figure utilized with the playset.

3. A toy playset as claimed in claim 1 wherein the means for simulating a trap is positioned in front of the opening of the simulated cage.

4. A toy playset as claimed in claim 1 wherein the means for simulating a monster comprises a hand puppet which may be extended to an area including that in front of the door to the simulated cage.

5. A toy playset as claimed in claim 1 wherein the monster simulated is a serpent.

6. A toy playset as claimed in claim 1 wherein the means simulating a tree is positioned so that it may grasp a toy action figure attempting to release the door of the simulated cage.

7. A toy playset as claimed in claim 1 in which the means for simulating a tree comprises a base portion, a first rotating portion positioned on the base portion and having at least one simulated limb, means for rotating the first rotating portion about the axis of the base portion, a second rotating portion positioned on the first rotating portion and having at least one simulated limb, and means for rotating the second rotating portion about the axis of the base portion.

* * * * *